US007900604B2

(12) United States Patent
Enke

(10) Patent No.: US 7,900,604 B2
(45) Date of Patent: Mar. 8, 2011

(54) DAMPENING STOP PIN

(75) Inventor: Olaf Enke, Columbia, SC (US)

(73) Assignee: Siemens Diesel Systems Technology, Blythewood, SC (US)

( * ) Notice: Subject to any disclaimer, the term of this patent is extended or adjusted under 35 U.S.C. 154(b) by 692 days.

(21) Appl. No.: 11/453,133

(22) Filed: Jun. 15, 2006

(65) Prior Publication Data

US 2006/0283984 A1 Dec. 21, 2006

Related U.S. Application Data

(60) Provisional application No. 60/690,899, filed on Jun. 16, 2005.

(51) Int. Cl.
*F02M 59/46* (2006.01)

(52) U.S. Cl. ..... 123/467

(58) Field of Classification Search ..... 239/88, 239/533.1–533.9, 90, 600, 87, 601; 92/52; 123/467, 301, 295, 294, 299
See application file for complete search history.

(56) References Cited

U.S. PATENT DOCUMENTS

| | | | | |
|---|---|---|---|---|
| 2,985,378 | A | | 5/1961 | Falberg |
| 3,257,078 | A | | 6/1966 | Mekkes |
| 3,464,627 | A | | 9/1969 | Huber |
| 3,831,863 | A | | 8/1974 | Fenne |
| 3,958,757 | A | | 5/1976 | Happel et al. |
| 4,448,169 | A | | 5/1984 | Badgley et al. |
| 4,566,635 | A | | 1/1986 | Trachte |
| 4,715,542 | A | | 12/1987 | Morell et al. |
| 4,878,650 | A | | 11/1989 | Daly et al. |
| 5,125,580 | A | | 6/1992 | Kornberger |
| 5,429,309 | A | | 7/1995 | Stockner |
| 5,551,391 | A | | 9/1996 | Beck et al. |
| 5,626,294 | A | | 5/1997 | McCandless |
| 5,632,444 | A | * | 5/1997 | Camplin et al. ..... 239/88 |
| 5,645,224 | A | | 7/1997 | Koch |
| 5,655,716 | A | | 8/1997 | Mathis |
| 5,692,683 | A | | 12/1997 | Mathis |
| 5,826,802 | A | | 10/1998 | Anderson et al. |
| 5,868,317 | A | | 2/1999 | English |
| 5,893,516 | A | | 4/1999 | Harcombe et al. |
| 5,950,931 | A | | 9/1999 | Beatty et al. |
| 5,992,767 | A | | 11/1999 | Phillips et al. |

(Continued)

OTHER PUBLICATIONS

Dr. Steven D. Phillips, Dimensional Metrology Program, Dec. 8, 2008, National Institute of Standards and Technology (NIST), p. 1(Description).*

(Continued)

*Primary Examiner* — Stephen K Cronin
*Assistant Examiner* — Keith Coleman
(74) *Attorney, Agent, or Firm* — McGuirewoods LLP

(57) ABSTRACT

A dampening stop pin that reduces a needle velocity at the time when the needle valve of a fuel injector is about to be seated in a closed position. A gap between a bottom surface of the stop-pin flange and a sealing seat of a nozzle is provided to compress the fuel trapped therein to form a fuel cushion that dampens the closing motion of the needle. Moreover, a diametrical clearance between an outer circumferential edge of the flange and an inner surface of a needle spring cage must be sized to prevent undesired high pressure from building up in the gap by venting a quantity of compressed fuel while still permitting the fuel cushion to dampen the closing force of the needle.

17 Claims, 5 Drawing Sheets

U.S. PATENT DOCUMENTS

| | | | | |
|---|---|---|---|---|
| 6,062,497 | A | 5/2000 | Bryan | |
| 6,092,744 | A | 7/2000 | Youakim | |
| 6,109,536 | A | 8/2000 | English | |
| 6,113,000 | A | 9/2000 | Tian | |
| 6,113,012 | A | 9/2000 | Wear et al. | |
| 6,119,962 | A | 9/2000 | Youakim et al. | |
| 6,257,203 | B1 | 7/2001 | Lei | |
| 6,290,148 | B1 | 9/2001 | Rizk et al. | |
| 6,318,646 | B1 | 11/2001 | Mattioli et al. | |
| 6,390,385 | B1 | 5/2002 | Hardy et al. | |
| 6,412,704 | B2 | 7/2002 | Shinogle et al. | |
| 6,499,467 | B1 | 12/2002 | Morris et al. | |
| 6,536,413 | B2 | 3/2003 | Mori | |
| 6,543,706 | B1 | 4/2003 | Hutchings et al. | |
| 6,575,388 | B2 | 6/2003 | Aota et al. | |
| 6,745,993 | B2 | 6/2004 | Mueller | |
| 6,793,161 | B1 | 9/2004 | Fujita et al. | |
| 6,830,201 | B2 | 12/2004 | Seelbach | |
| 6,840,458 | B2 * | 1/2005 | Kuzuyama | 239/88 |
| 6,874,704 | B2 | 4/2005 | Mack et al. | |
| 6,889,661 | B2 | 5/2005 | Duplat et al. | |
| 2003/0066509 | A1 | 4/2003 | Shafer et al. | |
| 2003/0172910 | A1 * | 9/2003 | Mattes et al. | 123/447 |
| 2003/0189112 | A1 | 10/2003 | Fukutomi et al. | |
| 2004/0011888 | A1 | 1/2004 | Seelbach et al. | |
| 2004/0011893 | A1 | 1/2004 | Heine et al. | |
| 2004/0050973 | A1 | 3/2004 | Yang et al. | |
| 2005/0173564 | A1 | 8/2005 | Cooke | |

OTHER PUBLICATIONS

Dr. L.M. Linares, Impact of Geometric Uncertainties Onto the Operating Performance of a Mechanical System, Apr. 10-12, 2005, 2005, Selected Conference Papers from the 9th CIRP International Seminar at Arizona State University, p. 1.*

Dr. Joseph K. Davidson, Impact of Geometric Uncertainties Onto the Operating Performance of a Mechanical System, May 19, 2007, Springer Netherlands, pp. 225-234; Website: http://www.springerlink.com/content/pl675687568w15g1/.*

Dr. Jun Qu, Development of Cylindrical Wire Electrical Discharge Machining Process and Investigation of Surface Integrity and Mechanical Property of EDM Surface Layers, 2002, North Carolina State University, pp. 22, 27, and 31.*

* cited by examiner

DAMPENING STOP PIN

CROSS-REFERENCE TO RELATED APPLICATION

This application claims the benefit of U.S. Provisional Patent Application No. 60/690,899, filed on Jun. 16, 2005, which is incorporated herein by reference in its entirety.

BACKGROUND OF THE INVENTION

1. Field of the Invention

The invention generally relates to a fuel injector and, more particularly, to a dampened stop pin that reduces the closing speed of the needle prior to seating at a needle seat to block the passage of fuel out of the nozzle spray holes.

2. Background Description

There are many types of fuel injectors designed to inject fuel into a combustion chamber of an engine. For example, fuel injectors may be mechanically, electrically or hydraulically controlled in order to inject fuel into the combustion chamber of the engine. In the hydraulically actuated systems, a control valve body may be provided with two, three or four way valve systems, each having grooves or orifices which allow fluid communication between working ports, high pressure ports and venting ports of the control valve body of the fuel injector and the inlet area. The working fluid is typically engine oil or other types of suitable hydraulic fluid capable of providing a pressure within the fuel injector in order to begin the process of injecting fuel into the combustion chamber.

In current designs, a driver delivers a current or voltage to an open side of an open coil solenoid. The magnetic force generated in the open coil solenoid shifts a spool into the open position so as to align grooves or orifices (hereinafter referred to as "grooves") of the control valve body and the spool. The alignment of the grooves permits the working fluid to flow into an intensifier chamber from an inlet portion of the control valve body (via working ports). The high-pressure working fluid then acts on an intensifier piston to compress an intensifier spring and hence compress fuel located within a high-pressure plunger chamber. As the pressure in the high-pressure plunger chamber increases, the fuel pressure will begin to rise above a valve opening pressure. At the prescribed fuel pressure level, the needle will shift against the stop pin and the biasing force of the needle spring and open the injection holes in a nozzle tip. The fuel will then be injected into the combustion chamber of the engine.

It is desirable to provide rapid closing of the needle after a fuel injection event in order to limit undesirable noise and improve engine emissions. The needle spring, however, contains a high mechanical load force when fully opened. As a result, closing the needle at a relatively high speed causes the needle to strike the needle seat proximate the nozzle tip with great force. Such an impact can severely damage the needle or may even cause the nozzle body to crack.

SUMMARY OF THE INVENTION

The invention solves the foregoing problems and avoids the disadvantage and drawbacks of the prior art by dampening the closing force of the needle by creating a fuel cushion and venting a quantity fuel from the cushion.

The invention may be implemented in a number of ways. In accordance with an embodiment of the invention, a nozzle body for a fuel injector includes a nozzle having at least one injection hole at a first section of said; a nozzle sealing surface at a second section that is spaced from the first section; and nozzle bore disposed between the first and second sections. The nozzle body may further include a movable needle having a portion disposed within the nozzle bore, a cage having an inner surface defining a cage bore, and a biasing mechanism disposed within the cage bore that biases the needle towards the injection hole in a closed position. Moreover the nozzle body has a dampening stop pin having a first portion upon which said biasing mechanism applies its biasing force, a second portion disposed adjacent said nozzle sealing surface, and a third portion disposed adjacent the inner surface of said cage. The second portion is spaced apart from the nozzle sealing surface at a first distance between approximately 180μ-320μ when the needle is in the closed position, and the third portion is spaced apart from the inner surface of the cage at a second distance between approximately 40μ-100μ.

In accordance with another embodiment of the invention, a method for dampening a closing force of a needle having open and closed positions in a fuel injector includes compressing fuel in a gap between a bottom surface of a stop pin flange and a nozzle sealing surface to provide a fuel cushion dampening the closing force of the needle, and venting a quantity of fuel from the gap through a diametrical clearance between an outer circumferential edge of the stop pin flange and an inner surface of a spring cage. The gap is about 180μ-320μ when the needle is in the closed position.

In accordance with yet another embodiment of the invention, a nozzle body for a fuel injector includes a nozzle having at least one injection hole at a first section, a nozzle sealing surface at a second section of the nozzle spaced from the first section; and a nozzle bore disposed between the first and second sections. The nozzle body also has a movable needle having a portion disposed within the nozzle bore, a cage having an inner surface defining a cage bore, and a biasing mechanism disposed within the cage bore that biases the needle towards the injection hole in a closed position. The nozzle body further includes a dampening stop pin having a portion upon which said biasing mechanism applies its biasing force and means for dampening the closing force of the needle by compressing fuel in a gap formed at least in part by the dampening stop pin and permitting a quantity of fuel to vent from the gap.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain principles of the invention. No attempt is made to show structural details of the invention in more detail than may be necessary for a fundamental understanding of the invention and the various ways in which it may be practiced. In the drawings.

DETAILED DESCRIPTION OF THE INVENTION

Figure 1:
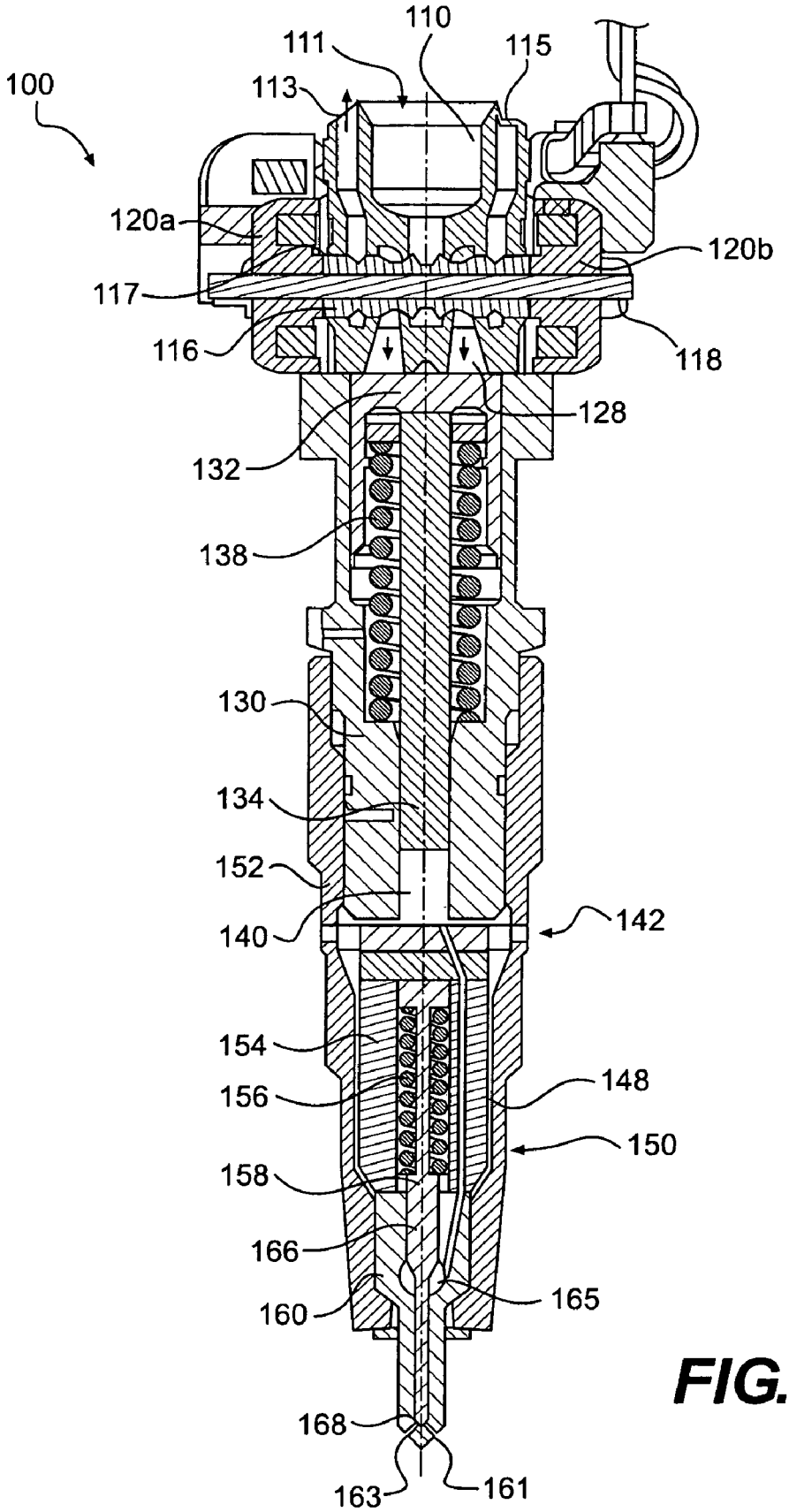
FIG. 1 illustrates an elevational cross-sectional view of a hydraulic actuated fuel injector using a dampening stop pin according to the principles of the invention.

The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings.

FIG. 1 illustrates a hydraulic actuated fuel injector 100, which may include a control valve body 110, an intensifier body 130, and a nozzle body assembly unit 150. Here, the control valve body 110 may have an inlet 111 and outlets 113, 115 that permit the flow of an actuating hydraulic fluid, such as oil, to enter and exit the intensifier body 130 at working ports 128. There may also be a longitudinally-slidable spool 116 having at least one orifice 117, or groove, that selectively allows fluid communication between the inlet 111 and outlets 113, 115 and the working ports 128. The control valve body 110 may further include a pair of opposing solenoid coils, an open coil 120*a* and a closed coil 120*b*, to actuate movement of the spool 116. A single bolt 118, which extends into a hollow interior space of the spool 116, may be used to fasten the solenoid end caps 120*a*, 120*b* to control valve body 110. Other types of fuel injector control bodies, such as a piezoelectric control body (not shown), may be used in lieu of the solenoid-type control body shown here.

FIG. 1 also shows an intensifier body 130 that may include a piston 132 and a plunger 134 biased toward the control valve body 110 by an intensifier spring 138. At an end of the plunger 134 opposite the piston 132, there may be an intensifier chamber 140 for pressurizing fuel that is in fluid communication with a fuel source (not shown) via a fuel inlet 142. A pressurized fuel path 148 may provide fluid communication between the intensifier chamber 140 and the nozzle body assembly unit 150. While one arrangement for pressurizing fuel is shown in FIG. 1, any suitable apparatus can be used for pressurizing fuel in accordance with the principles of the invention.

The intensifier body 130 may be coupled to the nozzle body assembly unit 150 using a nut 152, or any other suitable means, such as, for example, a press-fit or threading. The nozzle body assembly unit 150 includes a spring cage 154 and a nozzle 160. The spring cage 154 may have a needle spring 156 biasing a stop pin 158 towards the nozzle. The nozzle 160 can include a needle 166 that is biased by the stop pin 158 in a closed position against a needle seat 168 to occlude at least one injection or spray hole 163 located at the nozzle tip 161. The stop pin 158 and needle 166 can be separate components or one unitary piece. The nozzle 160 may also have a nozzle fuel chamber 167 that receives pressurized fuel from the intensifier chamber 140 via the pressurized fuel path 148.

Figure 2:
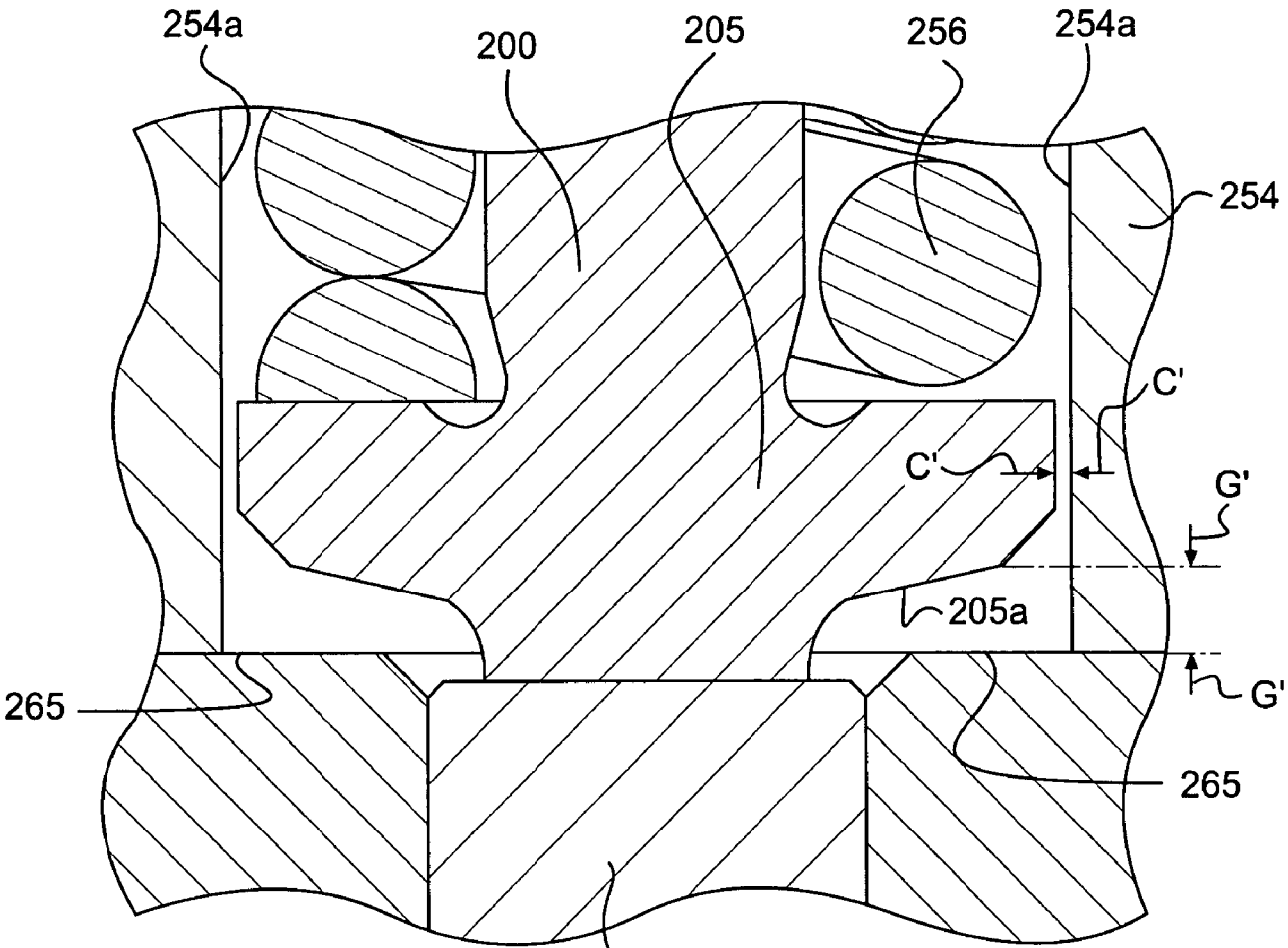
FIG. 2 (PRIOR ART)
FIG. 2 illustrates an elevational cross-sectional view of a typical prior art stop pin.

FIG. 2 shows a prior-art stop pin 200. The stop pin 200 has a substantially frustconical-shaped flange 205 and is biased towards needle 266 by a needle spring 256 disposed within spring cage 254. When the needle is seated in a closed position, there can be a gap (G') of approximately 0.7 mm between a bottom surface 205*a* of flange 205 and a sealing surface 265 of the nozzle 260. Further, a typical stop-pin, such as the one illustrated in FIG. 2, may have a diametrical clearance (C') of approximately 0.25 mm between the outermost portion of flange 205 and an inner, cylindrical surface 254*a* defining a bore within the spring cage 254.

Figure 3:
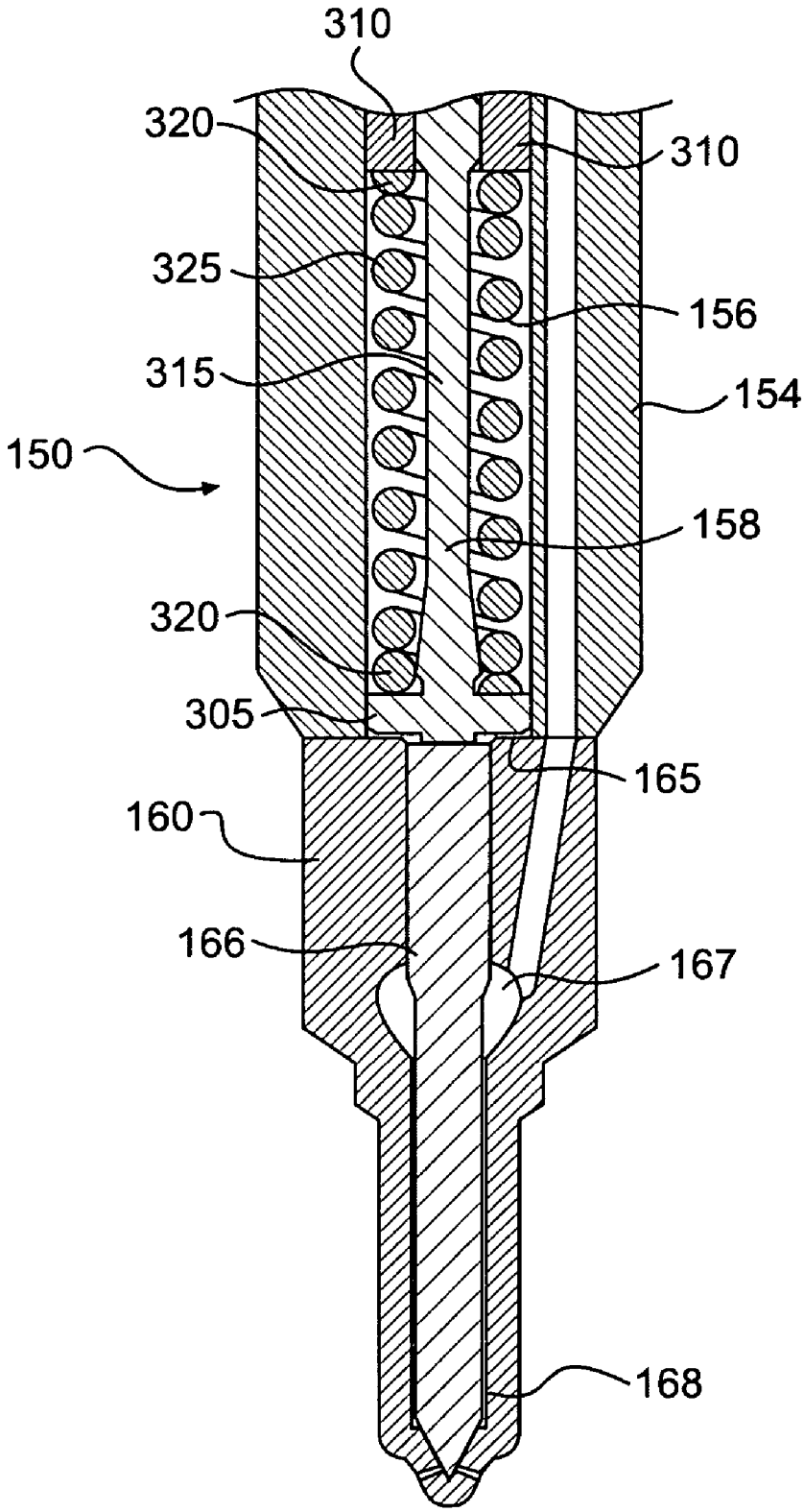
FIG. 3 illustrates a side elevational view of one embodiment of a dampening stop pin according to the principles of the invention.
Figure 3A:
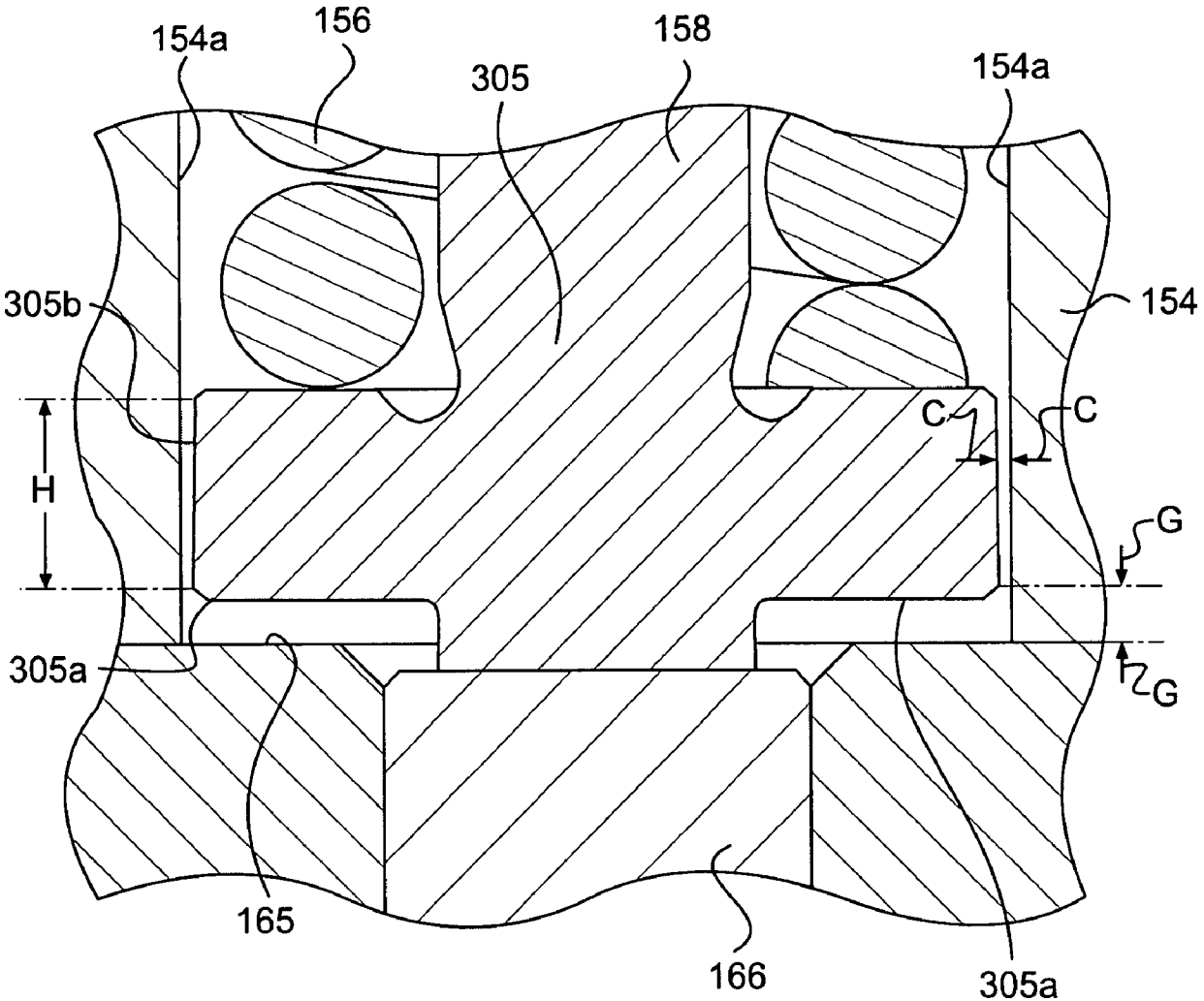
FIG. 3A is an enlarged view of the dampening stop pin of FIG. 3.

FIG. 3 illustrates an embodiment of a stop pin constructed in accordance with the principles of the invention. Stop pin 158 may comprise a substantially cylindrical-shaped flange 305. When the needle 166 is seated against the needle seat 168 in a closed position, a gap (G) between a bottom surface 305*a* of flange 305 and a sealing surface 165 of nozzle 160 is approximately 180μ-320μ, as best shown in the enlarged view of FIG. 3A. Further, the diametrical clearance (C) between the outermost circumferential edge 305*b* of flange 305 and an inner cylindrical surface 154*a*, which defines a bore within the needle spring cage 154, is sized approximately 40μ-100μ. Moreover, the height (H) of the flange 305 at its circumferential edge 305*b* preferably should not exceed about 1.2 mm-2.0 mm.

The stop pin may 158 further include a shim 310 at an end opposite the flange 305, as shown in FIG. 3. The shim 310 and flange 305 can be formed by stamping or turning, as well as any other suitable method, and may be joined by a cylindrical pin 315. The needle spring 156 may have dead end coils 320 that have a smaller outer diameter than the working coils 325. These dead end coils 320 may be disposed at either end, or both ends, of spring 156 to guide the axial motion of cylindrical pin 315 during the opening and closing of needle 166.

The operation of the fuel injector illustrated in FIG. 1 will now be discussed in detail.

A hydraulic fluid, such as oil, will enter the control valve body 110 at inlet 111. A driver will apply current to the open solenoid coil 120*a* to move the spool 116 into the open position to selectively permit fluid communication between the inlet 111 and the working ports 128 via grooves 117. The fluid at the working ports 128 passes into the intensifier body 130 and acts on the piston 132 and plunger 134 against the biasing force provided by the intensifier spring 138. The downward movement of the plunger 134, in response to hydraulic fluid, pressurizes the fuel in the intensifier chamber 140 supplied at the fuel inlet. The pressurized fuel proceeds to the nozzle body 160 via the pressurized fuel path 148.

The pressurized fuel enters the fuel chamber of nozzle body 160 and applies force to the needle 166, which moves the stop pin upwardly against the biasing provided by the needle spring 156 to unseat the needle 166 from its seat 168 and expose the injection holes 163 in the nozzle tip 161. A quantity of pressurized fuel can then be injected into a combustion chamber of an internal combustion engine or the like.

After a desired fuel injection period, the driver will supply current to a closed solenoid coil 120*b* that actuates movement of the spool 116 to a closed position that will block fluid communication between the inlet 111 and the working ports 128, and instead allow the hydraulic fluid to exit the intensifier body 130 by permitting fluid communication between the working ports 128 and the outlets 113, 115. The plunger 132 will then move upwardly in response to the biasing force provided by the intensifier spring 138 that no longer has the pressurized hydraulic fluid acting upon it. The upward movement of the plunger 132 may also suction a quantity of fuel into the intensifier chamber 140 for the next injection event.

Now the needle spring 156, which no longer has the pressurized fuel acting against its biasing force, will bias the stop pin 158 downwardly to rapidly reseat the needle 166 and occlude the injection holes 163. As the stop pin 158 returns to needle 166 the closed position, it will compress the fuel trapped in the gap (G) between the bottom surface 305*a* of stop pin flange 305 and the nozzle sealing seat 165. This compressed fuel can vent though the diametrical clearance (C) between the outer edge of flange 305*a* and the spring cage inner surface 154*a* and provides a fuel cushion that dampens the closing force of the stop pin 158.

If the gap (G) between the flange 305 and nozzle sealing surface 165 is too large, the fuel trapped in that gap will not be compressed enough to provide cushioning required for dampening. If this gap (G) is too small, however, the compressed fuel may interfere with needle closing and could even separate the stop pin 158 from the needle 166. Accordingly, a gap (G) between approximately 180μ-320μ is suitable for providing dampening while not adversely affecting needle closing.

Moreover, a portion of the compressed fuel needs to vent through the diametrical clearance (C) from the gap (G) to provide dampening without interfering with needle closing. If the diametrical clearance (C) is too small, then undesired high pressure may build up in the gap to interfere with needle closing. This undesired high pressure can also result if the fuel escape path along the clearance (C) is too long due to the thickness of the flange 305. On the other hand, if the diametrical clearance (C) is too large, the compressed fuel can escape too easily from the gap (G) and will not provide the desired dampening effect. Likewise, a diametrical clearance (C) between approximately 40μ-100μ is suitable for providing dampening while not adversely affecting needle closing.

Figure 4:
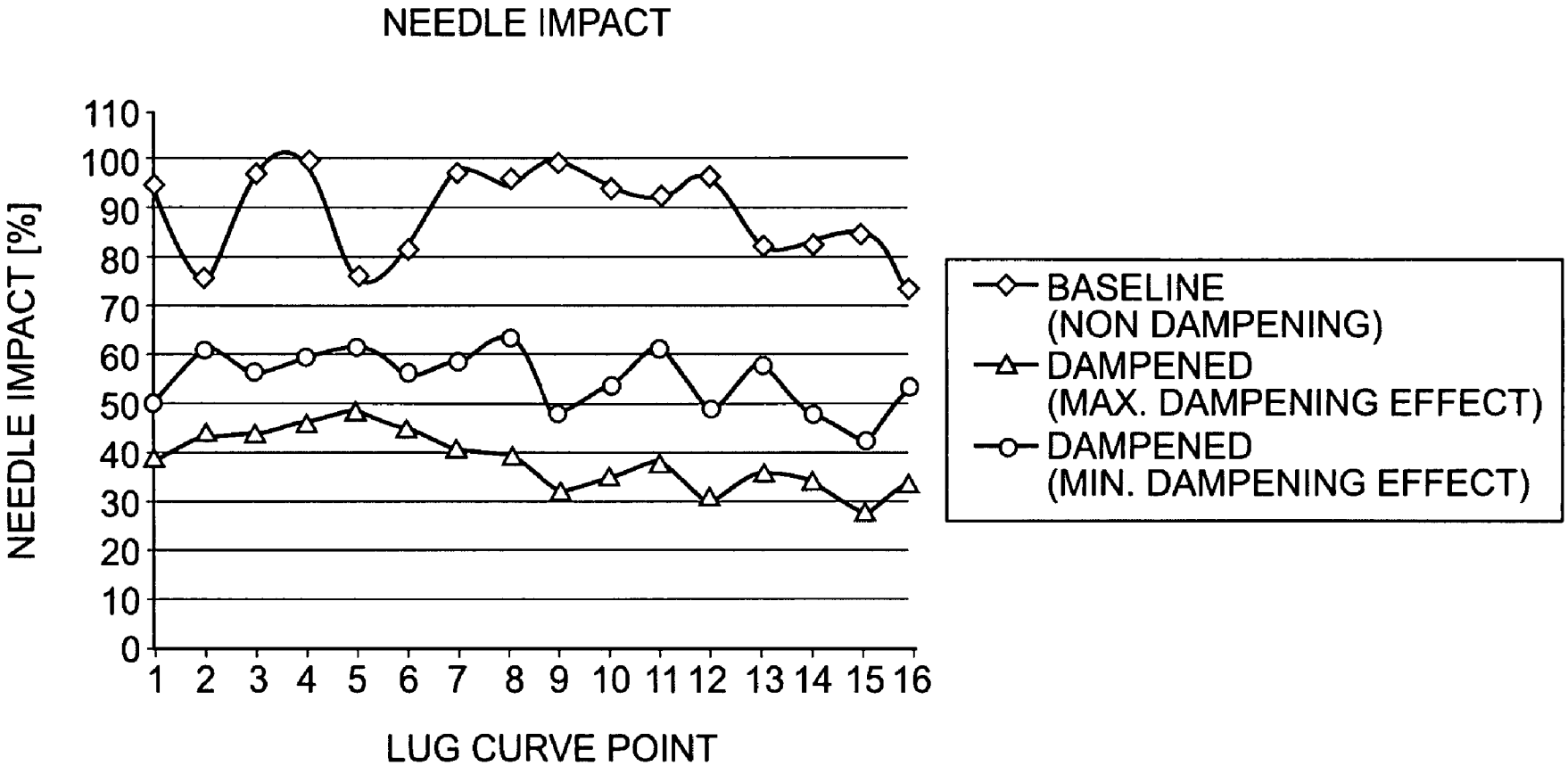
FIG. 4 is a graph comparing the needle impact vs. lug curve point of fuel injector having a dampening stop pin according to the principles of the invention with a fuel injector having a typical prior art stop pin.

FIG. 4 illustrates the performance of a dampening stop pin of the invention, as shown in FIG. 3, as compared to a prior art stop pin, shown in FIG. 2, over 300 fuel injection events. The graph shows that at all points of the lug-curve, the measured needle impact (in terms of percentage) is substantially lower using the dampening stop pin of the invention than the prior art stop-pin.

In summary, it is desirable to provide a gap between a flange of a dampening stop pin and a nozzle sealing surface large enough to prevent pressure from building up too high at an early stage of needle closing. At the same time, it is critical that this gap is small enough to maintain a fuel cushion as the needle becomes seated at the needle seat. By configuring the stop pin to provide dampening in such a manner, the invention can maintain a fast needle closing motion without substantially affecting the needle's opening properties.

While the invention has been described in terms of particular embodiments, those skilled in the art will recognize that the invention can be practiced with modifications in the spirit and scope of the appended claims. These examples given above are merely illustrative and are not meant to be an exhaustive list of all possible designs, embodiments, applications, or modifications of the invention.

I claim:

1. A nozzle body for a fuel injector, said nozzle body comprising:

a nozzle, including:

at least one injection hole at a first section of said nozzle;

a nozzle sealing surface at a second section of the nozzle spaced from the first section; and a first bore disposed between the first and second sections of the nozzle;

a movable needle having a portion disposed within the first bore;

a cage having an inner surface defining a second bore;

a biasing mechanism disposed within said second bore that biases said needle towards said at least one injection hole of said nozzle in a closed position; and a dampening stop pin, including:

a first portion upon which said biasing mechanism applies its biasing force, a second portion disposed adjacent said nozzle sealing surface;

a third portion disposed adjacent said inner surface of said cage;

a shim; and a cylindrical pin, wherein said shim is associated with a first end of said cylindrical pin and said first portion is a associated with a second end of the cylindrical pin;

wherein said second portion is spaced apart from said nozzle sealing surface at a first distance between approximately 180 microns and approximately 320 microns when said needle is in the closed position, and wherein said third portion is spaced apart from said inner surface of said cage at a second distance between approximately 40 microns and approximately 100 microns.

2. The nozzle body of claim 1, wherein said biasing mechanism is a spring that includes at least one dead end coil, said dead end coil having a smaller outer diameter than a working coil of the spring to guide motion of said cylindrical pin within said second bore.

3. The nozzle body of claim 1, wherein said biasing mechanism includes a first dead end coil proximate said shim and a second dead end coil proximate said first portion.

4. The nozzle body of claim 1, wherein said needle is integrally formed with said cylindrical pin of said stop pin.

5. The nozzle body of claim 1, wherein the first distance is between approximately 225 microns and approximately 275 microns.

6. The nozzle body of claim 1, wherein the first distance is approximately 250 microns.

7. The nozzle body of claim 1, wherein the height of the third portion is between approximately 1.2 mm and approximately 2.0 mm.

8. The nozzle body of claim 1, wherein the height of the third portion is approximately 1.6 mm.

9. The nozzle body of claim 1, wherein said dampening stop pin further comprises a flange including said first, second, and third portions, said second portion comprises a bottom surface of said flange, and said third portion comprises an outer edge of said flange.

10. The nozzle body of claim 9, wherein said flange is substantially cylindrical in shape and said outer edge is a circumferential edge of said substantially cylindrical flange.

11. The nozzle body of claim 10, wherein the first distance is a diametrical clearance between the outer circumferential edge of said substantially cylindrical flange and the inner surface of said cage.

12. The nozzle body of claim 9, wherein the second distance is a gap between the bottom surface of said flange and said nozzle sealing surface.

13. A method for dampening a closing force of a needle having open and closed positions in a fuel injector, said method comprising the steps of:

compressing fuel in a gap between a bottom surface of a flange of a stop pin and a nozzle sealing surface to provide a fuel cushion dampening the closing force of the needle;

venting a quantity of fuel from the gap through a diametrical clearance between an outer circumferential edge of the stop pin flange and an inner surface of a spring cage, wherein the diametrical clearance is between about 40 microns and about 100 microns when the needle is in a closed position;

biasing the stop pin against the needle towards the closed position using a spring disposed between a shim and a top surface of the flange; and guiding the stop pin using a dead end coil at a terminal end of the spring, the dead end coil having a smaller outer diameter than a working coil of the spring.

14. The method of claim 13, further comprising limiting the compression of fuel in the gap to prevent a separation of the stop pin from the needle.

15. The method of claim 13, wherein the gap is between about 180 microns and about 320 microns when the needle is in a closed position.

16. The method of claim 13, wherein the compression of the fuel in the gap is limited by sizing the height of the flange at the outer circumferential edge between approximately 1.2 mm and approximately 2.0 mm.

17. The method of claim 13, wherein the gap is about 250 microns.

* * * * *